US006138738A

United States Patent [19]

Moller et al.

[11] Patent Number: 6,138,738

[45] Date of Patent: Oct. 31, 2000

[54] EXTERNAL SCREENING DEVICE FOR A PIVOTABLE SKYLIGHT WINDOW

[75] Inventors: Brent Moller, Gentofte; Ulrik Ulriksen, Skjern, both of Denmark

[73] Assignee: VELUX Industri A/S, Søborg, Denmark

[21] Appl. No.: 09/194,055

[22] PCT Filed: Jun. 17, 1997

[86] PCT No.: PCT/DK97/00260

§ 371 Date: Nov. 20, 1998

§ 102(e) Date: Nov. 20, 1998

[87] PCT Pub. No.: WO97/48872

PCT Pub. Date: Dec. 24, 1997

[30] Foreign Application Priority Data

Jun. 18, 1996 [DK] Denmark ..... 0675/96

[51] Int. Cl.[7] ..... A47H 1/00

[52] U.S. Cl. ..... 160/98; 160/264; 160/310; 49/62; 52/202

[58] Field of Search ..... 160/23.1, 32, 33, 160/98, 100, 121.1, 238, 264, 265, 310, 331, 133, 266; 49/62, 63; 52/72, 200, 202

[56] References Cited

U.S. PATENT DOCUMENTS

| | | | |
|---|---|---|---|
| 1,142,918 | 6/1915 | Smith . | |
| 1,143,863 | 6/1915 | Schenk . | |
| 1,583,133 | 5/1926 | Fierman . | |
| 4,691,753 | 9/1987 | Baier . | |
| 4,762,160 | 8/1988 | Bechtold et al. | 160/98 |
| 4,846,242 | 7/1989 | Komatsu et al. . | |
| 4,956,588 | 9/1990 | Ming | 160/133 X |
| 5,249,616 | 10/1993 | Yen | 160/98 |
| 5,307,855 | 5/1994 | Martensson, IV | 160/310 X |
| 5,363,898 | 11/1994 | Sprague | 160/98 |
| 5,383,510 | 1/1995 | Allen | 160/310 |
| 5,479,979 | 1/1996 | Hayashiguchi | 160/265 |
| 5,540,269 | 7/1996 | Plumer | 160/310 X |
| 5,862,850 | 1/1999 | Yang | 160/264 X |

FOREIGN PATENT DOCUMENTS

| | | |
|---|---|---|
| 0683302A1 | 11/1995 | European Pat. Off. . |
| 2 595 403 | 9/1987 | France . |
| 2 683 259 | 5/1993 | France . |
| 2 693 229 | 1/1994 | France . |
| 3115926C2 | 11/1982 | Germany . |

*Primary Examiner*—Bruce A. Lev
*Attorney, Agent, or Firm*—Venable; John P. Shannon

[57] ABSTRACT

An external screening mechanism for a pivotable skylight window comprises a web of a screening material which is wound on a spring-biased roller and is connected with a bottom bar which is guided in side guide rails and connected via a cord drive with an unrolling drive unit. The side guide rails for the bottom bar run along the parts of the frame side portions situated above the axis of rotation and the parts of the sash side portions situated below the axis of rotation, and an essentially rod-shaped support arrangement is attached to and extends across the screening web and is led in the side guide rails so that, in a position of use for the screening mechanism, it is positioned at or close to the axis of rotation in parallel therewith. The device may be provided with an arrangement for retightening and smoothing the web in the fully drawn position and during rewinding.

26 Claims, 5 Drawing Sheets

EXTERNAL SCREENING DEVICE FOR A PIVOTABLE SKYLIGHT WINDOW

BACKGROUND OF THE INVENTION

The present invention relates to an external screening device for a pivotable skylight window with a horizontal axis of rotation of a sash in a centre area of the main frame of the window, comprising a continuous flexible screen which is wound on a roller situated at an upper horizontal frame portion of the window and is connected at its free end with a bottom bar guided in side guide rails, said bottom bar being connected for unrolling the screen over a cord drive with a drive unit which is also positioned in connection with the upper horizontal frame portion, said side guide rails for the bottom bar extending along the parts of the frame side portions placed above the axis of rotation and the parts of the sash side portions placed below the axis of rotation.

The two-part design of the side guide rails with upper sections running along the top part of the frame side portions and lower sections running along lower parts of the sash side portions is known per se from U.S. Pat. No. 4,691,753 for a screening device in the form of a roller shutter with relatively rigid slats guided in the side guide rails. The document as such deals with a design of the control cables which prevent jamming of the rigid slats in the guide rails.

From U.S. Pat. No. 1,583,133 there is known a screening device with a flexible material which is guided in hinged side rails and has rigid supporting rods for preventing sagging of the screening material. This screening device is not intended for a pivotable window, and the hinged guiding rails are, when in use, mounted on a window frame or equivalent in an aligned manner. The hinge itself is only used for folding the guide rails during shipment so as to save space. During shipment the flexible material is not present in the guide rails but wound on a roller.

If an external screening made of a flexible web is used in connection with a pivotable skylight window, eg. as shown in FIG., 1, where the lower portion of the window sash below the axis of rotation is turned outwards under an angle with the frame of typically between 10° and 60°, it is a problem that the screening web which extends between the upper horizontal frame portion and the lower horizontal sash portion shows a pronounced tendency to flutter or flap even by minor wind loads which partly involves the risk of wear and tear of the web, partly makes an annoying noise, while at the same time the esthetic appearance is deteriorated and light may penetrate through the uncovered opening between the web and the frame/sash construction.

Furthermore, when the window is closed, such screening devices have a tendency in a drawn-out condition and with a wet web to make the web stick to the pane which again, especially when seen from the inside, provides a severely deteriorated esthetic appearance and in addition can entail problems with rewinding the web on the roller.

SUMMARY OF THE INVENTION

According to the invention these problems may in all essentials be solved in that the screen comprises a continous web of a flexible material associated with an essentially rod-shaped support device which extends across the web essentially parallel to the bottom bar and is guided in the side guide rails, said support device being positioned, in a position of use for the screening device, at or close to the axis of rotation and parallel thereto.

Thereby, it is ensured that the web in unrolled condition follows the part of the frame construction positioned above the axis of rotation and the part of the sash construction positioned below the axis of rotation.

In a relatively simple embodiment, the support device may comprise a stiffening ledge fastened to the web in parallel with the bottom bar and at a distance herefrom corresponding essentially to the distance of the axis of rotation from the lower horizontal sash element. In this way, a low-cost production and mounting are obtained.

In particular by designs where the rewinding is not effected by means of spring power from a spring-biased roller such that a screening web unrolled at a closed window will flap heavily when opening the window, an essential esthetic improvement is obtained.

According to a further development of the invention, the support device may instead comprise a ledge which is displaceable with respect to the web and releasably coupled with the bottom bar whereby in the area opposite the axis of rotation, the side guide rails are provided with means for releasing the interconnection between the bottom bar and said ledge and arresting of the latter during continuous unrolling movement of the bottom bar.

Thereby, the ledge will function optimally with a correct positioning at the axis of rotation even though the web is not fully rolled out.

In a very simple and inexpensive design, a ledge of the stated kind may be positioned across the web without any other connection therewith than said releasable coupling to the bottom bar.

Furthermore, it is advantageous if means for retightening the web in the fully drawn position are connected to the drive unit or the cord drive.

Such tightening means may according to a preferred embodiment be realized in that the drive unit for the unrolling movement is an electric motor with means comprising a sensing device for switching-off the current for the motor in said fully drawn position of the screening web during simultaneous securing of the retightening of the web.

A further advantageous design is obtained if in the vicinity of and parallel to the roller, a device in the form of a rod or a cylinder is provided for retightening and smoothing of the web during rewinding. Such a device will furthermore entail that precipitation in the form of snow or icing gathered on the web will be broken so that it may slide down from web or be removed from the web in order not be rewound together with the web.

BRIEF DESCRIPTION OF THE DRAWINGS

The invention is explained in the following with reference to the schematic drawing where.

DETAILED DESCRIPTION OF THE PREFERRED EMBODIMENTS

Figure 1:
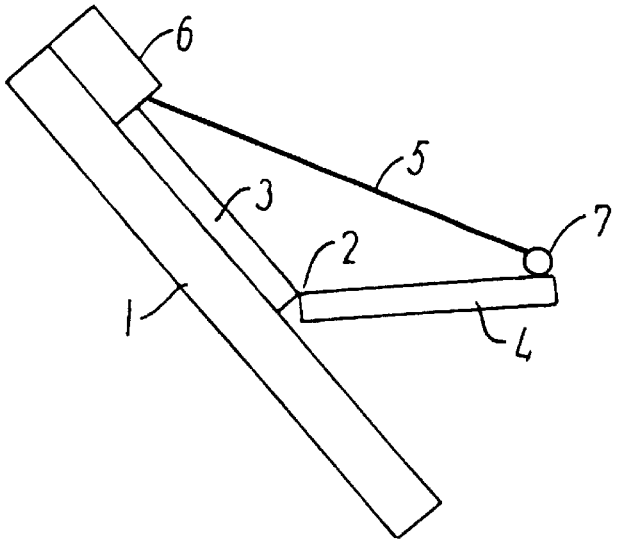
FIG. 1 illustrates a screening device known per se and used in connection with a pivotable skylight window.

In the schematic side view in FIG. 1, numeral 1 represents a pivotable skylight window mounted in an inclined roof surface and with an axis of rotation for the pivot movement situated at 2 in a centre area of the window frame and sash of which the figure only shows the part 3 of a frame side portion situated above the axis of rotation and the part 4 of a sash side portion situated below the axis of rotation.

An external screening device in the form of a roller screen comprises a continuous web 5 of a flexible screening material, which can be wound on a roller bar not shown in the figure, said roller bar being placed in a top casing 6 at the upper horizontal frame portion of the window and being connected at its free end with a bottom bar 7 which is guided in not shown side guide rails mounted on the parts 3 and 4 of the side portions of the frame and sash, respectively.

In the illustrated open position of the window, the screening web will in a fully unrolled condition be stretched out between the upper horizontal frame portion and the bottom bar 7 positioned at the lower horizontal sash portion and even at small wind blasts it will show a strong tendency to flutter resulting in the aforesaid disadvantages.

In the screening device according to the invention shown in FIGS. 2–6, for which parts corresponding to those shown in FIG. 1 are designated by the same referential numerals, this disadvantage is remedied in that an essentially bar-shaped support device in the form of a stiffening ledge 8 or 18, respectively, is attached to and extends across the screening web 5 and is guided in the same side guide rails 9 and 10 as the bottom bar 7.

Figure 2:
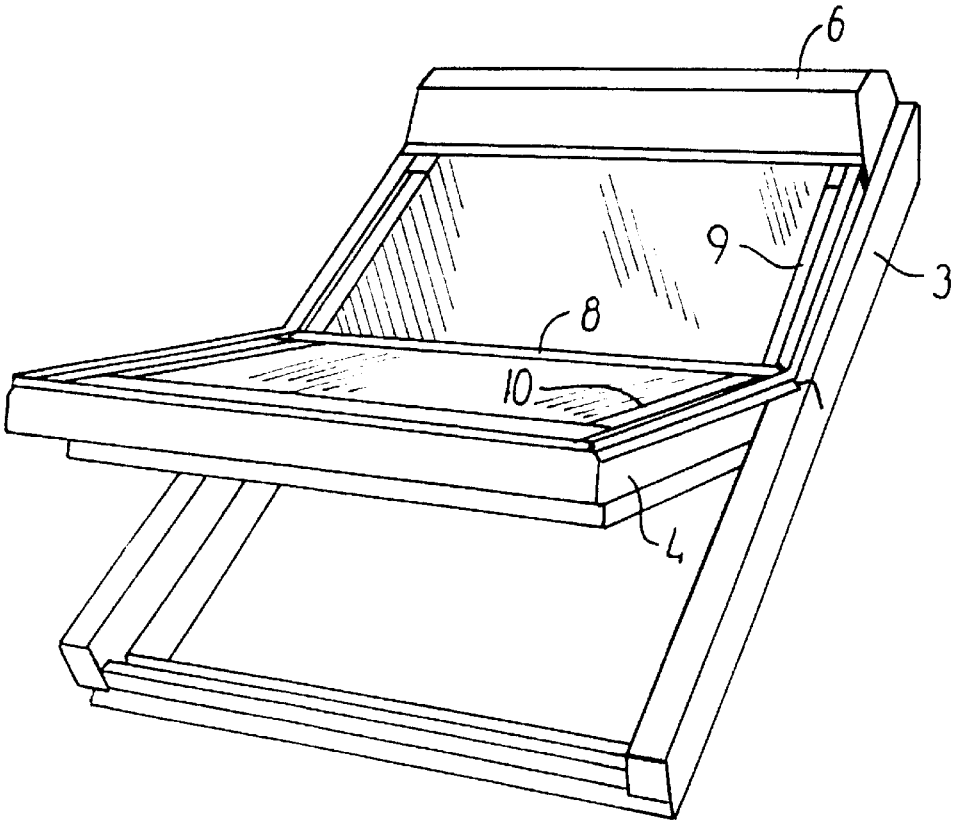
FIG. 2 is a perspective view of a pivotable skylight window with a first embodiment of the screening device according to the invention.
Figure 3:
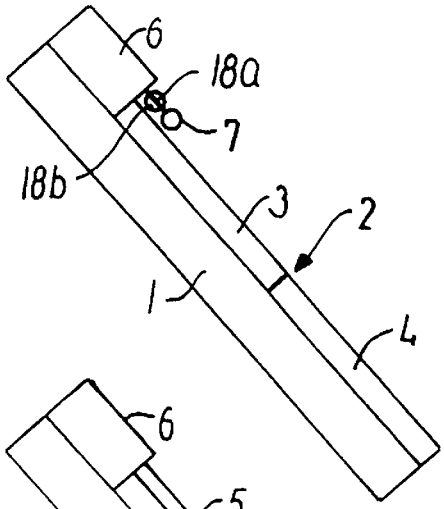
FIGS. 3–6 illustrate another embodiment of the screening device in different positions of the screening web.
Figure 4:
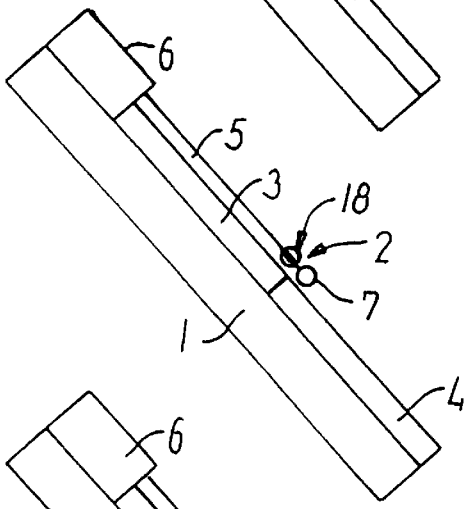

The stiffening ledge 8 or 18 respectively, may be manufactured of plastics, wood or metal with an arbitrary cross-sectional profile. In a simple and inexpensive design it may as shown in FIG. 2 consist of one ledge profile 8 which by sewing in, riveting, gluing, welding or in a similar way has been fastened directly to the web 5 on the place which in the unrolled position lies opposite the axis of rotation 2 of the window. The stiffening ledge 8 will thus constantly follow the web 5 during unrolling and rewinding.

As the stiffening ledge 8 is guided in the side guide rails 9 and 10 mounted on the parts 3 of the frame side portions positioned above the axis of rotation 2 and the parts 4 of the sash side portions positioned below the axis of rotation 2, respectively, the web 5 with the stiffening ledge 8 mounted in an unrolled condition will be made to follow the outlines of the said parts of the frame and sash constructions.

As appears from FIGS. 3–6 showing schematic side views of a pivotable skylight window with a screening device according to the invention the stiffening ledge, which here is designated by 18, may alternatively be designed as a double or slotted ledge profile in displaceable connection with the web 5 and comprising two parts 18*a* and 18*b* situated on either side of the web.

Figure 5:
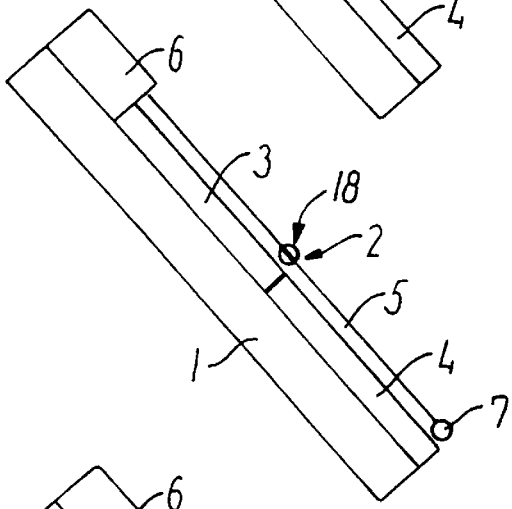
Figure 6:
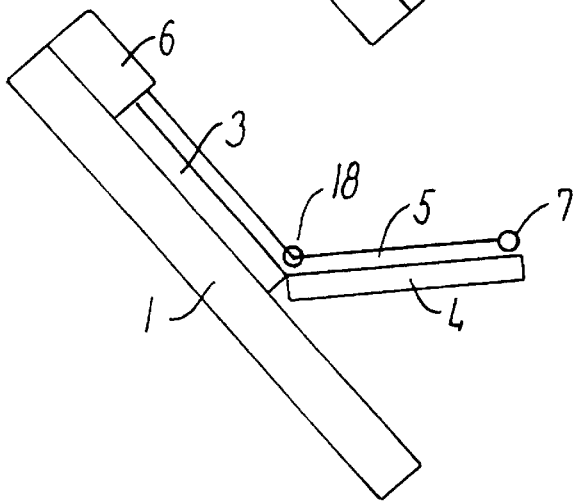

In this design the stiffening ledge 18 is releasably coupled to the bottom bar 7, eg. by means of clips, magnets, hooks or alike or by capsizing, and as further appears from the following in connection thereto means not shown in FIGS. 3–6 are provided at the bend between the side guide rails 9 and 10 for releasing the interconnection between the bottom bar 7 and the stiffening ledge 18, so that during continuous unrolling movement of the bottom bar, the ledge will be maintained arrested in a position parallel to and in the vicinity of the axis of rotation 2, as is best seen in FIG. 6.

Figure 7:
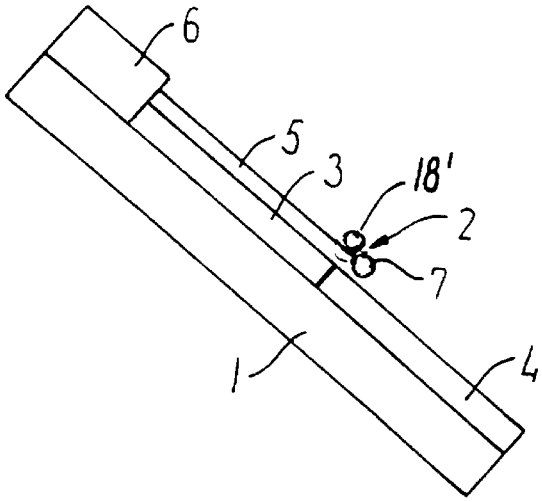
FIG. 7 is a modification of the embodiment in FIGS. 3–6, FIGS. 8 and 9 show alternative embodiments of means for releasable interconnection of a screening device as shown in FIGS. 3–7 with the bottom bar of the web.

However, as shown in FIG. 7, a support device with the same function may also shown in FIG. 7, in a more simple design be designed as a ledge 18' positioned across the web without any other connection therewith than the releasable coupling to the bottom bar 7.

Figure 8:
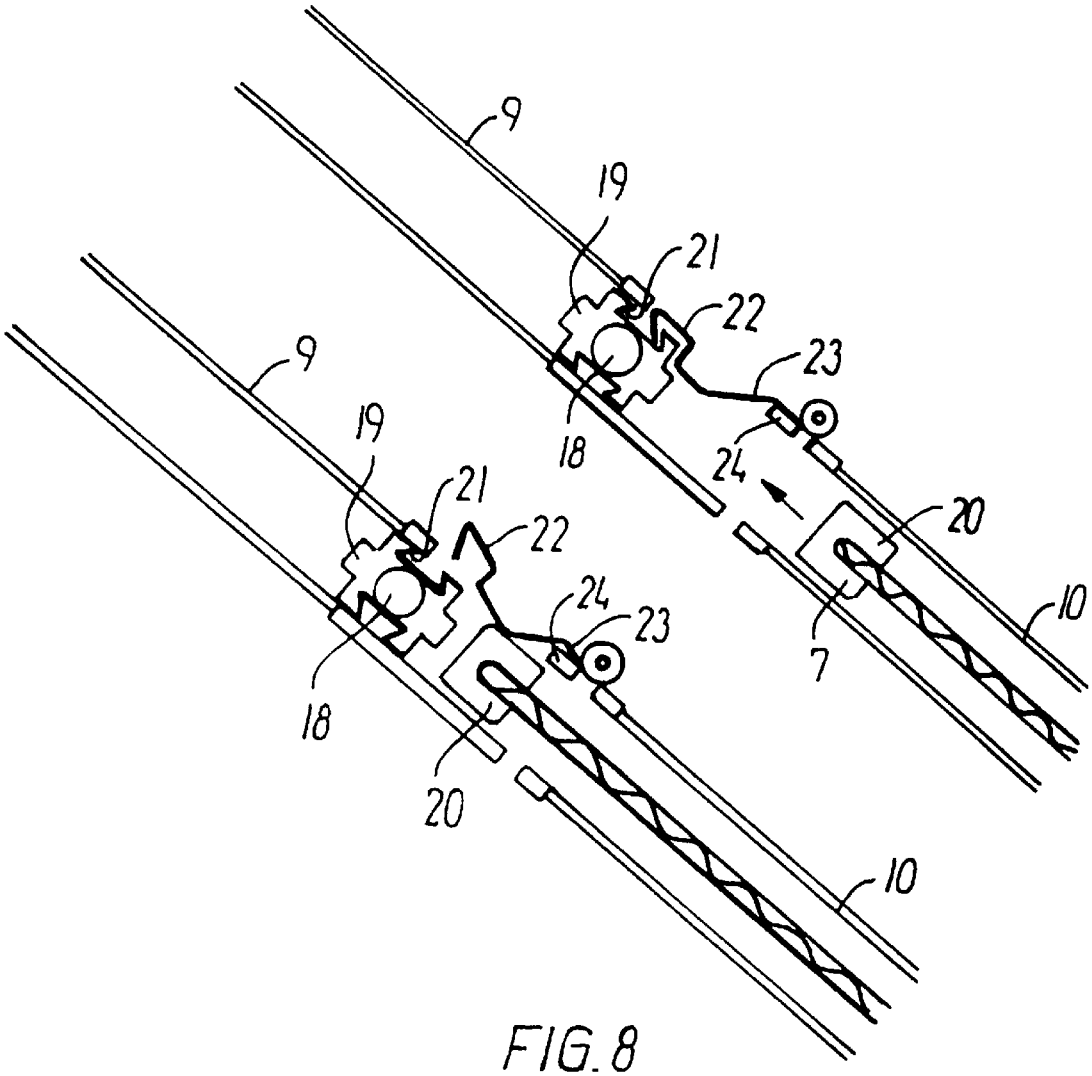

In the embodiment in FIG. 8, the parts 19 and 20, respectively, of the stiffening ledge 18 and the bottom bar 7 guided in the side guide rails are interconnected, e.g. magnetically, and the guide element 19 for the stiffening ledge 18 is at least at one side designed with an engagement groove 21 which can enter in engagement with a hooked end part 22 of a stop device in the form of a bent spring element 23 mounted on the outside of the side guide rails at the transition between the rails 9 and 10 and protruding into the rail cavity through an aperture 24 such that after passage of the guide element 20 designed with smooth side faces it may enter into engagement with the groove 21 with its hooked end part 22.

Figure 9:
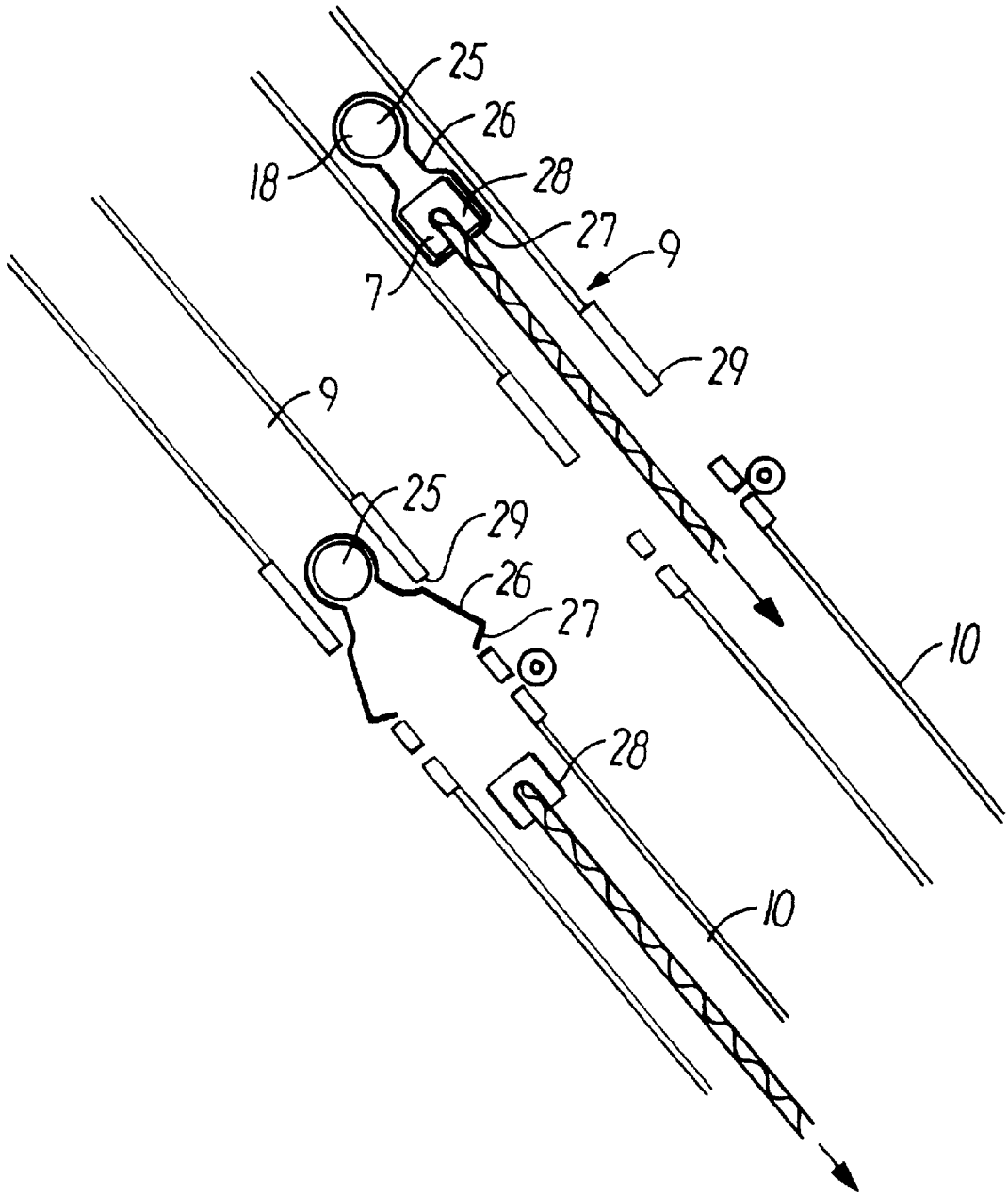

In the embodiment in FIG. 9, the interconnection between the stiffening ledge 18 and the bottom bar 7 is provided in that the guide element 25 for the stiffening ledge 18 is envelopped by a clip-like coupling element in the form of a bent spring element 26 with hooked end parts 27 which during movement of the guide elements in the side guide rail 9 connected to the part 3 of a frame side portion situated above the axis of rotation grasps the guide element 28 connected to the bottom bar, but at the break point between the side guide rails 9 and 10 as a consequence of the spring bias is forced outwards in openings 29 between the two side guide rails 9 and 10.

The releasable interconnection between the stiffening ledge 18 and the bottom bar can of course be designed in many other ways.

In order to avoid that the screening web 5 in the fully unrolled position shown in FIG. 5 at a closed window tends to stick to the outer face of the window pane which entails a strongly reduced esthetic appearance, especially when seen from within, means for retightening the web in the fully drawn position are, according to the invention, attached to the drive unit or cord drive for the unrolling movement of the screening web 5.

Figure 10:
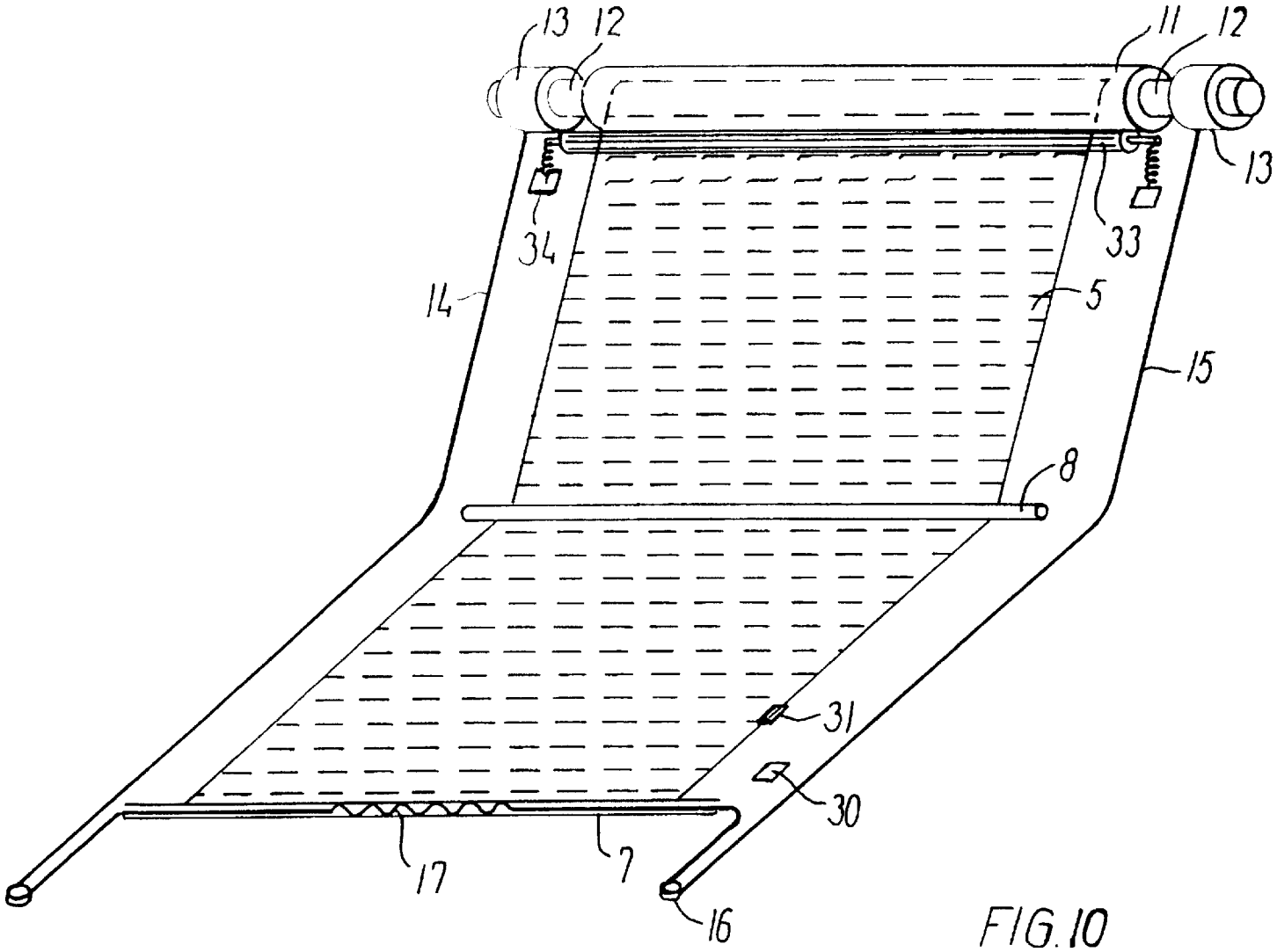
FIG. 10 is a perspective view of an embodiment having means for retightening and smoothing the web during the movement of unrolling and rewinding.

In the embodiment in FIG. 10, the screening web is wound on a spring-biased roller 11 such that the rewinding movement of the web is effected by means of the thus produced spring force which in itself contributes to keeping the web 5 tightened in any position. The roller will, however, not always be spring-biased as both the rewinding and unrolling movement may be effected by means of cord drive.

The unrolling movement is here electrically activated by means of a drive unit in the form of a not shown tubular motor positioned inside the roller 11 and provided with output shafts 12 which are coupled to two rewinding drums 13 positioned at each end of the roller for a cord drive comprising two draw cords 14 and 15 which via reversing reels 16 at the bottom of the side guide rails 10 connected with the part 4 of each sash side portion placed below the axis of rotation 2 are led into the bottom bar 7 where ends of the cords 14 and 15 are connected over a retightening spring 17.

The special retightening means according to the invention are preferably electrically activated.

As one possibility for such an electrical activation, there may in connection with the motor control circuit for the drive motor be mounted a sensing device measuring the motor current and disrupting it at a certain overcurrent or breaking level obtained by tightening the draw cords 14 and 15 when the bottom bar 7 reaches its bottom position corresponding to a complete unrolling of the web. Before this breaking level is attained, the retightening spring 17 in the bottom bar will, however, be fully stretched with the result that too much web is unrolled such that the unrolled web is slackened and tends to rest directly against the pane or stick thereto.

According to the invention this can be counteracted by such an arrangement of the motor control circuit that in connection with detecting the breaking level the circuit ensures a short reverse of the drive motor such as to run backwards for e.g. 1 sec. whereby the spring bias on the roller 11 assures the retightening of the web 5.

As another possibility there may in connection with each of the side guide rails 10 be mounted a contact element, e.g. a Hall-element with a sensor 30 which is affected by an element 31 directly connected with the web for indicating whether the web 5 is fully unrolled and thus ensures disruption of the motor current when too much web is rolled out.

As an alternative to this possibility, there may in connection with the motor output shafts 12 be placed a tacho disc affecting a contact element, e.g. a Hall-element for sending information to a microprocessor indicating how many rotations the drive motor has made in order that the number of rotations corresponding to a fully, but not too much, unrolled web can be stored and used for disruption of the motor before too much web is rolled out.

In the embodiment in FIG. 10, there is furthermore in the vicinity of and parallel to the roller bar 11 arranged a device 33 in the form a rod or a roller which through pressure on the web 5, e.g. by means of a spring bias 34 results in a retightening and smoothing of the web during rewinding. Such a retightening and smoothing device will further entail that precipitation in the form of snow or icing which has gathered on the web will be broken and thus slide down from the web or be removed in order not to be rewound together with the web.

As can be seen from FIGS. 6 and 10 in which the web is bent around the stiffening ledge 18, with the portion of the web below the stiffening ledge extending at an angle relative to the portion of the web above the stiffening web, the stiffening ledge constitutes an axis about which a part of the continuous web of flexible screening material can bend.

What is claimed is:

1. An external screening device for a pivotable skylight window having a main frame with a centre area, frame side portions, and an upper horizontal frame portion, and a sash pivotable about a horizontal axis of rotation in said centre area and having sash side portions, said main frame having side guide rails extending along parts of said side portions placed above said axis of rotation and said sash having side guide rails extending along parts of said sash side portions placed below said axis of rotation, said screening device comprising a roller, a drive unit, and a cord drive which are adapted to be situated at said upper horizontal frame portion of the window, a continuous web of a flexible screening material which is wound on said roller and is connected at a free end with a bottom bar adapted to be guided in said side guide rails, said bottom bar being connected via said cord drive to said drive unit for unrolling the screen, and a generally rod-shaped support device which extends across the web of flexible screening material substantially parallel to said bottom bar and is adapted to be guided in said side guide rails, said support device defining, in a position of use for the screening device, an axis about which a part of the continuous web of flexible screening material can bend, said screening material being movable relative to the generally rod-shaped support device.

2. A screening device according to claim 1, wherein said support device comprises a stiffening ledge fastened to the web at a distance from the bottom bar.

3. A screening device according to claim 1 wherein means for retightening the wed in a fully drawn position are attached to one of the drive unit and the cord drive for the unrolling movement.

4. A screening device according to claim 3, wherein the drive unit for the unrolling movement is an electric motor with a motor current and switching means comprising a sensing device for switching-off said motor current in said fully drawn position of the screening web during simultaneous securing of the retightening of the web.

5. A screening device according to claim 4, wherein said sensing device comprises an overcurrent sensor for the motor current in connection with reversal means for short reversal of the motor after said switching-off of the motor current.

6. A screening device according to claim 4, wherein said sensing device comprises a contact member adapted to be arranged at a lower part of a side guide rail and actuated by a member connected with the web.

7. A screening device according to claim 6, wherein said contact member is a Hall sensor.

8. A screening device according to claim 1, wherein in a vicinity of and parallel to the roller a device having a shape selected from among rod-shaped and cylindrical is provided for retightening and smoothing the web during rewinding.

9. An external screening device for a pivotable skylight window having a main frame with a centre area, frame side portions, and an upper horizontal frame portion, and a sash pivotable about a horizontal axis of rotation in said centre area and having sash side portions, said main frame having side guide rails extending along parts of said side portions placed above said axis of rotation and said sash having side guide rails extending along parts of said sash side portions placed below said axis of rotation, said screening device comprising a roller, a drive unit, and a cord drive which are adapted to be situated at said upper horizontal frame portion of the window, a continuous web of a flexible screening material which is wound on said roller and is connected at a free end with a bottom bar adapted to be guided in said side guide rails, said bottom bar being connected via said cord drive to said drive unit for unrolling the screen, and a generally rod-shaped support device which extends across the web of flexible screening material substantially parallel to said bottom bar and is adapted to be guided in said side guide rails, said support device defining in a position of use for the screening device an axis about which a part of the continuous web of flexible screening material can bend, wherein the support device comprises a ledge displaceable with respect to the web and releasably coupled with said bottom bar, whereby said support device is adapted to cooperate with said side guide rails for releasing and arresting of the said ledge during continuous unrolling movement of said bottom bar.

10. A screening device according to claim 9, wherein the ledge is arranged across the web without any other connection therewith than said releasable coupling to the bottom bar.

11. A screening device according to claim 9, wherein the ledge is designed as a ledge profile with two parts placed on either side of the web, the ledge profile comprising one of a double profile and a slotted profile.

12. Pivotable skylight window having a main frame with a centre area, frame side portions, and an upper horizontal frame portion, and a sash pivotable about a horizontal axis of rotation in said centre area of said main frame and having sash side portions, said main frame having side guide rails extending along parts of frame side portions placed above said axis of rotation and said sash having side guide rails extending along parts of said sash side portions placed below said axis of rotation, said window comprising a roller, a cord drive and a drive unit for said cord drive which are situated at said upper horizontal frame portion, a continuous web of a flexible screening material which is wound on said roller and has a bottom bar guided in said side guide rails, said bottom bar being connected to said cord drive for unrolling the screen, and a generally rod-shaped support device which extends across the web and is guided in said side guide rails, said support device being positioned, in a position of use for the screening device adjacent said axis of rotation, said support device further constituting an axis about which a part of the continuous web of flexible screening material can bend, said screening material being movable relative to the generally rod-shaped support device.

13. A pivotable window according to claim 12, in which said sash has at a distance from said axis of rotation a lower horizontal sash element and wherein said support device comprises a stiffening ledge fastened to the web at a distance from the bottom bar corresponding in general to the distance of the axis of rotation from said lower horizontal sash element.

14. Pivotable skylight window having a main frame with a centre area, frame side portions, and an upper horizontal frame portion, and a sash pivotable about a horizontal axis of rotation in said centre area of said main frame and having sash side portions, said main frame having side guide rails extending along parts of frame side portions placed above said axis of rotation and said sash having side guide rails extending along parts of said sash side portions placed below said axis of rotation, said window comprising a roller, a cord drive and a drive unit for said cord drive which are situated at said upper horizontal frame portion, a continuous web of a flexible screening material which is wound on said roller and has a bottom bar guided in said side guide rails, said bottom bar being connected to said cord drive for unrolling the screen, and a generally rod-shaped support device which extends across the web and is guided in said side guide rails said support device being positioned, in a position of use for the screening device adjacent said axis of rotation, said support device further constituting an axis about which a part of the continuous web of flexible screening material can bend, wherein the support device comprises a ledge displaceable with respect to the web and releasably coupled with the bottom bar, and wherein in the side guide rails in an area opposite the axis of rotation releasing means are provided for releasing an interconnection between the bottom bar and said ledge and arresting said ledge during continuous unrolling movement of said bottom bar.

15. A pivotable window according to claim 14, wherein the ledge is arranged across the web without any other connection therewith than said releasable coupling to the bottom bar.

16. A pivotable window according to claim 14, wherein the ledge is designed as a ledge profile with two parts placed on opposite sides of the web, the ledge profile being selected from among double profiles and slotted profiles.

17. A pivotable window having a main frame with centre area, frame side portions, and an upper horizontal frame portion, and a sash pivotable about a horizontal axis of rotation in said centre area of said main frame and having sash side portions and a lower horizontal sash element, side guide rails extending along parts of said frame side portions from said centre area towards said upper horizontal frame portion and along parts of said sash side portions from said centre area towards said lower horizontal sash element, said window comprising a roller, a cord drive and a drive unit for said cord drive, a continuous web of a flexible screening material which is wound on said roller and has a bottom bar guided in said side guide rails, said bottom bar being connected to said cord drive, and a support device which extends across the web and is guided in said side guide rails, said support device being positioned, in a position of use for the screening device, adjacent said axis of rotation, said support device further constituting an axis about which a part of the continuous web of flexible screening material can bend, said screening material being movable relative to the generally rod-shaped support device.

18. A pivotable window according to claim 17, wherein said lower horizontal sash element sash is at a distance from said axis of rotation, and said support device comprises a stiffening ledge fastened to the web at a distance from the bottom bar corresponding in general to the distance between the axis of rotation and said lower horizontal sash element.

19. A screening device according to claim 17, wherein means for retightening the web in a fully drawn position are attached to one of the drive unit and the cord drive for the unrolling movement.

20. A screening device according to claim 19, wherein the drive unit for the unrolling movement is an electric motor with a motor current and switching means comprising a sensing device for switching-off said motor current in said fully drawn position of the screening web during simultaneous securing of the retightening of the web.

21. A screening device according to claim 20, wherein said sensing device comprises an overcurrent sensor for the motor current in connection with reversal means for short reversal of the motor after said switching-off of the motor current.

22. A screening device according to claim 20, wherein said sensing device comprises a contact member arranged at a lower part of a side guide rail and actuated by a member connected with the web.

23. A screening device according to claim 22, wherein said contact member is a Hall sensor.

24. A pivotable window having a main frame with centre area, frame side portions, and an upper horizontal frame portion, and a sash pivotable about a horizontal axis of rotation in said centre area of said main frame and having sash side portions and a lower horizontal sash element, side guide rails extending along parts of said frame side portions from said centre area towards said upper horizontal frame portion and along parts of said sash side portions from said centre area towards said lower horizontal sash element, said window comprising a roller, a cord drive and a drive unit for said cord drive, a continuous web of a flexible screening material which is wound on said roller and has a bottom bar guided in said side guide rails, said bottom bar being connected to said cord drive, and a support device which extends across the web and is guided in said side guide rails, said support device being positioned, in a position of use for the screening device, adjacent said axis of rotation, said support device further constituting an axis about which a part of the continuous web of flexible screening material can bend, wherein the support device comprises a ledge displaceable with respect to the web and releasably coupled with the bottom bar, and wherein in the side guide rails in an area opposite the axis of rotation releasing means are provided for releasing an interconnection between the bottom bar and said ledge and arresting said ledge during continuous unrolling movement of said bottom bar.

25. A pivotable window according to claim 24, wherein the ledge is arranged across the web without any other connection therewith than said releasable coupling to the bottom bar.

26. A pivotable window according to claim 24, wherein the ledge is designed as a ledge profile with two parts placed on opposite sides of the web, the ledge profile being selected from among double profiles and slotted profiles.

* * * * *